US005973587A

United States Patent [19]

Hofsäss

[11] Patent Number: 5,973,587

[45] Date of Patent: Oct. 26, 1999

[54] TEMPERATURE-DEPENDENT SWITCH HAVING A CONTACT BRIDGE

[76] Inventor: Marcel Hofsäss, Höfener Strasse 29, 75305 Neuenbürg, Germany

[21] Appl. No.: 09/104,964

[22] Filed: Jun. 25, 1998

[30] Foreign Application Priority Data

Jun. 26, 1997 [DE] Germany ..... 197 27 197

[51] Int. Cl.[6] ..... H01H 37/14; H01H 37/54

[52] U.S. Cl. ..... 337/377; 337/333; 337/343; 337/53; 337/77

[58] Field of Search ..... 337/102, 103, 337/104, 16, 36, 97, 298, 333, 343, 377, 390, 53, 77, 100

[56] References Cited

U.S. PATENT DOCUMENTS

| | | | |
|---|---|---|---|
| 2,753,421 | 7/1963 | Mertler | 337/380 |
| 3,023,350 | 2/1962 | Broadley et al. | 318/782 |
| 3,265,839 | 8/1966 | Johnson | 337/91 |
| 3,308,255 | 3/1967 | Faggiano | 337/267 |
| 3,496,511 | 2/1970 | Colavecchio | 337/343 |
| 4,476,452 | 10/1984 | D'Entremont | 337/102 |
| 4,862,132 | 8/1989 | Hollweck | 337/102 |
| 5,309,131 | 5/1994 | Hofsass et al. | 337/102 |
| 5,489,762 | 2/1996 | Martin et al. | 219/510 |
| 5,615,072 | 3/1997 | Hofsass et al. | 361/24 |

FOREIGN PATENT DOCUMENTS

| | | |
|---|---|---|
| 0114071 | 7/1984 | European Pat. Off. . |
| 3122899 | 10/1984 | Germany . |
| 3701240 | 8/1987 | Germany . |
| 8911524 | 1/1990 | Germany . |
| 4424027 | 5/1996 | Germany . |

*Primary Examiner*—Leo P. Picard
*Assistant Examiner*—Anatoly Vortman
*Attorney, Agent, or Firm*—Harness, Dickey & Pierce, P.L.C.

[57] ABSTRACT

A temperature-dependent switch has a temperature-dependent switching mechanism and a housing, receiving the switching mechanism, that has a lower part and an upper part made of insulating material. On the inner side of the upper part there are two stationary contacts, each of which is connected to an external terminal associated with it. A current transfer member is moved by the switching mechanism, which electrically connects the two stationary contacts to one another as a function of temperature. A cavity, into which project two contact surfaces which are each connected to one of the stationary contacts, is located in the upper part.

18 Claims, 3 Drawing Sheets

TEMPERATURE-DEPENDENT SWITCH HAVING A CONTACT BRIDGE

BACKGROUND OF THE INVENTION

1. Field of the Invention

The present invention relates to a temperature-dependent switch having a temperature-dependent switching mechanism, a housing, receiving the switching mechanism, that has a lower part and an upper part made of insulating material, two stationary contacts provided on the upper part on its inner side, each of which is electrically connected to an external terminal associated with it, and a current transfer member, moved by the switching mechanism, which electrically connects the two stationary contacts to one another as a function of temperature.

2. Related Prior Art

A switch of this kind is known from DE 26 44 411 C2.

The known switch has a housing with a cup-like lower part into which a temperature-dependent switching mechanism is placed. The lower part is closed off by an upper part that is retained on the lower part by means of the elevated rim thereof. The lower part can be produced from metal or from insulating material, while the upper part is in any case produced from insulating material.

Two rivets, whose inner heads serve as stationary contacts for the switching mechanism, sit in the upper part. The switching mechanism carries a current transfer member in the form of a contact bridge, which depending on the temperature is brought into contact with the two stationary contacts and then electrically connects them to one another.

The external heads of the two rivets serve as solder terminals for conductors.

The temperature-dependent switching mechanism has, in a manner known per se, a bimetallic disk and a spring disk, through which a pin which carries the contact bridge passes centeredly. The spring disk is guided circumferentially in the housing, while the bimetallic disk is braced, depending on the temperature, either against the bottom of the lower part or against the rim of the spring disk, and thereby either allows contact between the contact bridge and the two stationary contacts, or lifts the contact bridge away from the stationary contacts so that the electrical connection between the external terminals is interrupted.

This temperature-dependent switch is used, in known fashion, to protect electrical devices from overheating. For this, the switch is connected electrically in series with the device to be protected, and is arranged mechanically on the device so that it is thermally connected thereto. Below the response temperature of the bimetallic disk, the contact bridge rests against the two stationary contacts so that the circuit is closed and power is supplied to the device to be protected. If the temperature rises above a permissible value, the bimetallic disk then lifts the contact bridge away from the stationary contact, so that the switch opens and the power supply to the device to be protected is interrupted so that the latter can cool off, whereupon the switch then automatically closes again.

Although the known switch meets a number of technical requirements, it still has a series of disadvantages which are associated with its manufacture, its installation on a device to be protected, and automatic closing after cooling off.

One disadvantage lies in the complex production of the known switch: after manufacture of the cover, the rivets must still be attached to it later. A further disadvantage is the fact that conductors must also be soldered onto the external rivet heads; this generally cannot be automated. This means, however, that manufacture of a ready-to-connect switch, packaged with conductors, is in this case time-consuming and thus costintensive.

Further disadvantages may be seen in conjunction with the installation of the known switch on a device to be protected. On the one hand, the known switch offers only solder terminals or conductors, while crimp or screw terminals are often required today. If the lower part is produced from plastic, thermal coupling to the device to be protected is relatively poor in the case of the known switch, while if the lower part is produced from metal, good thermal coupling can be implemented, but the elevated metal rim of the lower part must then often be electrically insulated from the outside.

In summary, therefore, the disadvantages with the known switch are not only the laborious, complex manufacture but also the installation possibilities on a device to be protected, which are not sufficient for many applications.

In this connection, DE 31 22 899 C2 discloses a temperature-dependent switch having a lower housing part made of metal and an upper housing part made of insulating material. Two connector tongues, the first of which is connected to a stationary contact arranged centeredly, are insert-molded into the upper part. The second connector tongue is equipped with clips which, when the upper part is installed, are electrically connected to the lower part.

Arranged in the interior of the closed housing thus constituted is a bimetallic switching mechanism that, as a function of its temperature, creates an electrically conductive connection between the stationary contact and the lower housing part, and thus between the two connector tongues.

A disadvantage with this switch is the fact that assembly, in particular the arrangement of the upper part on the lower part, is laborious, since for the purpose, the clips configured integrally with the second connector tongue must be correspondingly folded over. In the event of production errors or inaccuracies, the reliability of the electrical connection between the connector clip and the lower part is not guaranteed.

Here again, as with the switch mentioned at the outset, the elevated lower part made of metal requires lateral insulation for certain applications.

A further disadvantage of the known switch is the fact that the connector tongues project upward vertically from the upper part, which interferes with installation on the device to be protected and, in particular, with electrical connection.

A further disadvantage evident with this switch is also the fact that it automatically switches on again after cooling. While switching characteristics of this kind may be entirely sensible for protecting a hair dryer, the two switches so far described are not suitable for protecting devices that must not switch back on automatically after cooling, as may be the case, for example, with electric motors. In this connection, it is already known from many publications to equip the temperaturedependent switch with a so-called "self-hold" function, for which purpose a resistor is connected in parallel with the external terminals. After the switching mechanism opens, a low current flows through said resistor, which thereby generates sufficient heat to keep the switching mechanism above its switching temperature so that the switch does not close again automatically. This is instead accomplished by shutting off the supply voltage, so that the switching mechanism is no longer kept above the switching temperature by the current flowing through the self-hold resistor.

SUMMARY OF THE INVENTION

In view of the above, it is an object of the present invention to create a switch of the kind mentioned at the outset which is easy to manufacture and simple to install on a device to be protected, in which a self-hold function can be selectably implemented.

In the case of the switch mentioned at the outset, this object is achieved according to the invention by the fact that there is provided in the upper part a cavity, open preferably to the outside, into which contact surfaces project that are each connected to one of the stationary contacts.

The object underlying the invention is completely achieved in this fashion.

Specifically, the inventor of the present application has recognized that it is possible, initially even without changes in the design of the known switch, to provide a cavity, open preferably toward the outside, into which a resistor can be inserted in such a way that it comes into contact at its connecting surfaces with the two contact surfaces. As a result, the resistor is connected in series between the two external terminals, so that it is bypassed by the switching mechanism when the switching mechanism is closed, i.e. below its response temperature. If the temperature of the switching mechanism rises above the permissible value, the short circuit is opened so that now a low current flows through the resistor, generating sufficient heat to hold the switching mechanism open.

Because the cavity is provided, so to speak, between the stationary contacts in the upper part, the heating resistor is located relatively close to the switching mechanism, so that even low currents are sufficient to generate the necessary ohmic heat.

If it is not necessary to equip the switch with a self-hold function, a blind plug can also be inserted into the cavity instead of a resistor, so as to externally insulate the contact surfaces which are freely accessible in the cavity. In terms of production engineering, the new switch offers great advantages inasmuch as after it is produced, it can either be equipped with a self-hold function or delivered without that function. Two different switch models can thus be manufactured in a single production operation, which understandably is extremely cost-effective.

Another great advantage is the fact that no complex assembly actions are needed in order to install the resistor provided for the self-hold function on the new switch. The resistor simply needs to be inserted, preferably from outside, into the cavity, where it then automatically comes into contact with the contact surfaces. The resistor can be of any design; a PTC resistor which has corresponding connecting surfaces at which it rests against the contact surfaces is preferred.

With the new switch, it is thus preferred if there is placed into the cavity a resistor which is connected to both contact surfaces so that it is connected in series between the external terminals and provides a self-hold function; it is preferred if the resistor is press-fitted or adhesively bonded into the cavity, and/or is preferably externally insulated by means of a heat-shrink sleeve surrounding the switch.

These features are also advantageous in terms of production engineering, since in order to be installed, the resistor simply needs to be slid into the cavity, where it is either mechanically retained or held in place by adhesive bonding. Additionally and/or alternatively, the switch can be surrounded by a heat-shrink sleeve which externally insulates the resistor; the heat-shrink sleeve can moreover also provide for mechanical retention of the resistor, so that adhesive bonding or pressfitting can be entirely or partially dispensed with.

It is advantageous in this context if two connector electrodes, each of which is connected to one of the stationary contacts, to one of the contact surfaces, and to one of the external terminals, are insert-molded into the upper part.

The inventor of the present application has recognized that with the new switch, it is possible to insert-mold into the upper part connector electrodes which connect the stationary contacts on the inner side of the upper part to external terminals outside the upper part. A particular advantage is present here in terms of manufacture of the new switch, since in a first step the connector electrodes can be connected to stationary contacts and to the external terminals, whereupon the connector electrodes are then, so to speak, insert-molded or injectionembedded when the upper part is injection molded. In other words, during manufacture of the upper part itself, the external terminals and the stationary contacts are simultaneously attached to it. In addition, the cavity can also be configured during injection molding of the upper part, thereby making available there the contact surfaces at which contact can be made with a resistor. The upper part (with attachment of the connector electrodes), and the cavity provided for attachment and contact to the resistor, can thus be produced in a single production step.

A further advantage is to be seen in the fact that by selecting the shape of the connector electrodes, the external terminals can now be placed in any desired geometrical fashion with respect to the stationary contacts, and the external terminals themselves can now be configured as solder, crimp, or screw terminals.

A further advantage of the new switch is thus to be seen in the fact that it can be installed much more easily on the device to be protected because the connector technology necessary for each device can be provided.

In an improvement of the new switch, it is preferred if each connector electrode is a flat metal part with which the respective external terminal, which preferably projects laterally out of the upper part, is configured integrally, the connector electrodes furthermore preferably lying parallel and next to one another in the upper part.

The advantage here is that additional connections can readily be made to the external terminals located "next to" the switch, thus simplifying installation of the new switch on a device to be protected.

In addition, the new switch is also simple to produce, since the connector electrodes can be delivered in belt-mounted fashion; they also result in good stability for the upper part since they are metal parts of planar configuration. This planar configuration moreover results in better heat absorption and heat dissipation into the interior of the new switch to the temperature-dependent switching mechanism.

It is further preferred if the respective contact surface is configured on the respective metal part.

As already mentioned above, the advantage here lies in the fact that when the upper part is injection molded, the cavity into which the metal parts project, for example, laterally can automatically be left open so that regions of its surface there act as contact surfaces.

It is further preferred in the case of the new switch if each stationary contact is welded onto the associated connector electrode.

This feature is also advantageous in terms of production engineering, since after the connector electrode with pertinent external terminal is punched out, the stationary contact merely needs to be welded on in a subsequent step before injection-embedding into the upper part. A further advantage to be seen here is that a portion of the connector electrode is not bent forward as the stationary contact, but rather the connector electrode itself remains, so to speak, as a planar part onto which the stationary contact is welded. This results, however, in unequivocal geometrical conditions; errors in punching out or bending the connector electrodes cannot cause changes in the relative positions of the stationary contacts. Solely for the sake of completeness, it should be mentioned that the two stationary contacts must lie at approximately the same height so that the contact bridge can reliably make contact with both stationary contacts.

In general, it is preferred in the case of the new switch if the lower part is configured in a dish shape and the upper part in a cup shape, and if the upper part annularly overlaps the lower part at its rim, the lower part preferably being produced from metal.

The advantage here is that the lower part, produced from metal, yields good thermal contact between the new switch and the device to be protected, although sufficiently good electrical insulation is nevertheless achieved by means of the cup-shaped upper part made of insulating material. Good external sealing of the housing also results, because the rim of the upper part which annularly overlaps the lower part can be hot-stamped or welded.

It is further preferred in this context if the lower part has at its rim an external peripheral groove with which a ridge, configured internally on the rim of the upper part, is in engagement.

The advantage here is that, in a manner of speaking, a snap connection results between the upper part and lower part, simultaneously representing a kind of labyrinth seal by means of which the interior of the housing is protected from the entry of dirt, etc. This feature therefore not only provides for highly dust-tight sealing of the housing, but moreover also allows simple production, since after the switching mechanism is set in place, the upper part and lower part simply need to be snap-locked to one another in order to join all the parts of the switch to one another in lossproof fashion. The switch can then be transported in any desired fashion to a welding or stamping station where the projecting rim is welded or stamped.

Lastly, it is optionally possible to insert, at any desired point in the production process, an additional production step in which either a resistor or a blind plug is introduced into the cavity so as selectably to effect a self-hold function. In this context, the resistor is either pressed in, press-fitted in, or adhesively bonded in; additionally or alternatively, it can be retained and/or insulated by means of a heat-shrink sleeve.

Further advantages are evident from the description and from the appended drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

An embodiment of the invention is shown in the appended drawings and will be explained in more detail in the description below. In the drawings.

DESCRIPTION OF PREFERRED EMBODIMENTS

Figure 1:
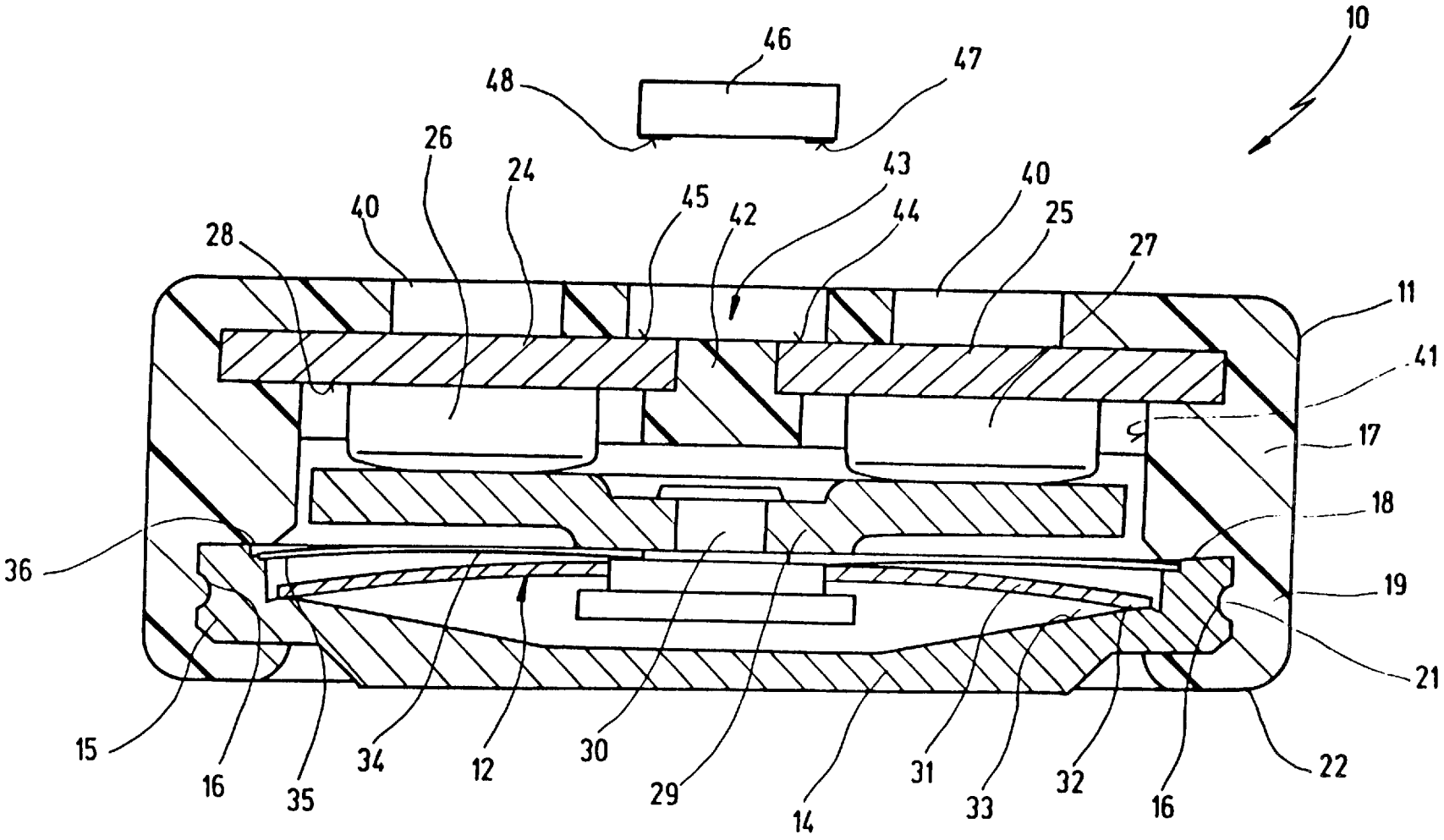
FIG. 1 shows a longitudinal section through the new switch along line I—I of FIG. 3, with the resistor sketched at the top.

In FIG. 1, 10 designates a temperature-dependent switch which has a housing 11 in which a temperature-dependent switching mechanism 12 is arranged.

Housing 11 comprises a dish-shaped lower part 14 on whose elevated rim 15 an external peripheral groove 16 is provided. A cup-shaped upper part 17 is braced with an inner shoulder 18 on elevated rim 15. Projecting above shoulder 18 is a rim 19 on which an internally peripheral ridge 21 is provided, which is in engagement with groove 16 so that lower part 14 is snap-locked to upper part 17.

Rim 19 transitions into an annular overlap 22 by means of which lower part 14 is further retained on upper part 17. Said overlap 22 can be produced by stamping or welding a projecting region of rim 19.

While upper part 17 is produced from insulating material, lower part 14 can also be produced from insulating material or from metal; a lower part made of metal results in better thermal contact between switch 10 and a device to be protected.

Two connector electrodes 24, 25 located next to one another, each of which carries a welded-on stationary contact 26, 27, are insert-molded into upper part 17. The two stationary contacts 26, 27 are thus arranged on an inner side 28 of upper part 17.

Associated with the two stationary contacts 26, 27 is a current transfer member in the form of a movable contact bridge 29, which is connected via a rivet 30 to temperature-dependent switching mechanism 12. In known fashion, switching mechanism 12 comprises a bimetallic disk 31 which, in the switch position shown, is braced at its rim 32 against a bottom 33 of lower part 14. Switching mechanism 12 further comprises a spring disk 34 which is guided circumferentially at its rim 35 in a peripheral groove 36 which is configured between shoulder 18 and rim 15.

Depending on the temperature, switching mechanism 12 then brings contact bridge 29 into contact with the two stationary contacts 26, 27 or lifts it away from them. The specific operation of the bimetallic switching mechanism is described in DE 26 44 411 C2 mentioned initially, so that reference may be made to that document for further information.

Figure 3:
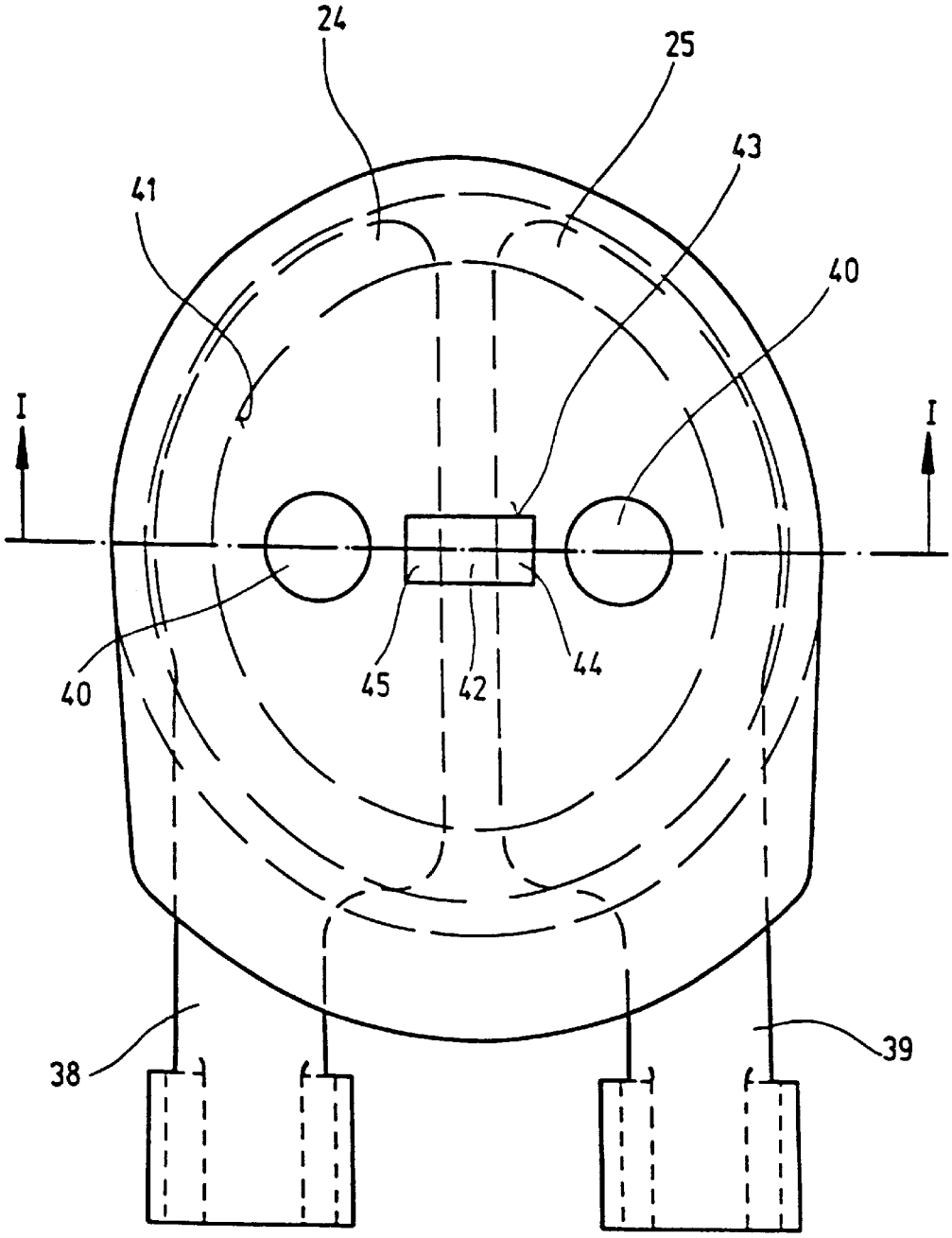
FIG. 3 shows a plan view of the switch shown in FIG. 1.

It is evident from the plan view of the new switch 10 shown in FIG. 3 that the two connector electrodes 24, 25, shaped like knife blades, are joined integrally to external terminals 38, 39 which, in the case shown, are provided as crimp terminals. When contact bridge 29 is in contact with the two stationary contacts 24, 25, the two external terminals 38, 39 are consequently connected electrically to one another, i.e. switch 10 is closed. It is also evident from FIG. 3 that an annular space 41 is provided in upper part 17 to receive switching mechanism 12.

Stationary contacts 26, 27 are moreover welded or soldered onto connector electrodes 24, 25. Provided in upper part 17, set away from stationary contacts 26, 27, are two openings 40 leading outward; through these, on the one hand, switch 10 is thermally coupled to a device to be protected, while on the other hand these openings can also be provided for test purposes, specifically in order to heat up the interior of switch 10 as quickly as possible by means of a heated plunger, and/or to make contact externally to the two stationary contacts 26, 27 by means of test probes in order to test the operation of switch 10.

During production, switching mechanism 12 is placed into upper part 17 or lower part 14, housing 11 is closed off by snap-locking between upper part and lower part 14, and lastly annular overlap 22 is created by stamping or welding. In this context, openings 40 are used to push upper part down onto lower part 14. The production precision achieved by means of the pressure that is thus exerted via the electrodes is better than if pressure had been exerted directly on plastic regions of upper part 17, since dimensional stability in the latter area is poorer.

Returning to FIG. 1, the latter also shows a tab 42 which insulates the two electrodes 24, 25 from one another transversely. Provided above tab 42 is an externally open cavity 43 into which the two electrodes 24, 25 extend laterally so that they face into cavity 43 with contact surfaces 44, 45. Tab 42, cavity 43, and contact surfaces 44, 45 are also clearly visible in the plan view of FIG. 3.

In FIG. 1, a resistor 46 which has two connecting surfaces 47, 48 is arranged above switch 10. Resistor 46 is of parallelepi-pedal configuration, so that it can be pressed into cavity 43 such that its connecting surfaces 47, 48 come into contact with contact surfaces 44, 45. Resistor 46 is preferably a PTC resistor, but any desired type of resistor can be used.

Resistor 46, inserted in this fashion into cavity 43, can be press-fitted or snap-locked therein; it is also possible, for example, to adhesively bond resistor 46 once it is in place, to prevent it from falling out of cavity 43 and at the same time to ensure good electrical contact between connecting surfaces 47, 48 and contact surfaces 44, 45.

Resistor 46 is thus connected in series between electrodes 24, 25, and thus between external terminals 38, 39. In the switching state shown in FIG. 1, resistor 46 is bypassed by contact bridge 29, so that it performs no electrical function.

If the switching temperature of switch 10 is then exceeded, switching mechanism 12 lifts contact bridge 29 away from stationary contacts 26, 27 so that resistor 46 is then connected electrically in series between external terminals 38 and 39, and current flows through it. That current is less than the original operating current, since there is an additional voltage drop through resistor 46. The heat generated in resistor 46 passes via electrodes 25, 26 and tab 42 into annular space 41, where it ensures that switching mechanism 12 does not cool off again below the changeover temperature. In other words, the residual current flowing through resistor 46 causes switch 10 to enter a self-holding state, i.e. not to close again automatically. Only when the operating current is switched off does switch 10 cool off so that it can return to the state shown in FIG. 1.

Figure 2:
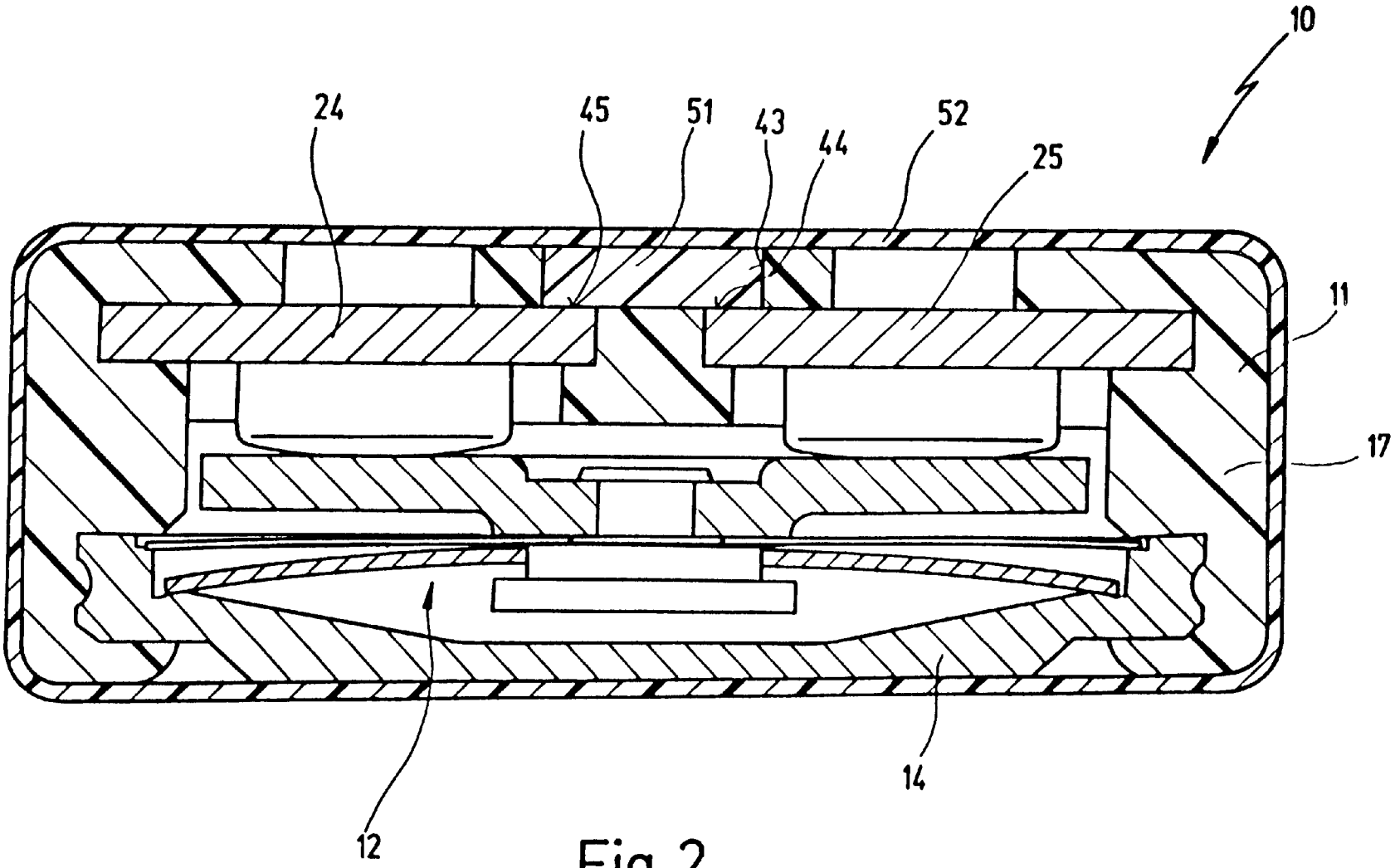
FIG. 2 shows a representation like that of FIG. 1, but with an insulating plug introduced into the cavity and with a surrounding heat-shrink sleeve.

If switch 10 is not to be equipped with a self-hold function, then instead of resistor 46 a blind plug 51, for example, is placed into cavity 43 as shown in FIG. 2. Said blind plug 51 is made of insulating material, and protects contact surfaces 44, 45. Blind plug 51 also can be retained in cavity 43 by press-fitting, snap-locking, or adhesive bonding; in FIG. 2, a heat-shrink sleeve 52 which surrounds the entire switch 10 is provided for the purpose. Said heat-shrink sleeve 52 presses blind plug 51 into cavity 43 and holds it therein in lossproof fashion. A resistor 46 inserted into cavity 43 can, of course, also be retained solely by a heat-shrink sleeve 52.

When the new switch 10 is produced, connector electrodes 24, 25 are injection-embedded in insulating material, thus forming upper part 17 inclusive of cavity 43 and annular space 41. With a single operation, therefore, connector electrodes 24, 25 are integrated into upper part 17 and a receiving space is created for a possible resistor 46. Said receiving space is the parallelepipedal cavity 43, into which a geometrically adapted resistor 46 can be placed as necessary. The additional production step by which the new switch 10 is equipped with a self-hold function is thus extremely simple: resistor 46 simply needs to be inserted into cavity 43 which is provided as a standard feature.

Therefore, what I claim is:

1. A temperature-dependent switch, comprising:

a temperature-dependent switching mechanism, a housing for containing said temperature-dependent switching mechanism, said housing including a lower part and an upper part, said upper part made of insulating material and having an inner side and an outer side, two stationary contacts provided on the inner side of said upper part, each stationary contact being connected to an associated external terminal and having a contact surface on said inner side of said upper part, and a current transfer member moved by said temperature-dependent switching mechanism to electrically connect said two stationary contacts to one another in dependence of the temperature of said temperature-dependent switching mechanism, a cavity being provided in said upper part and open to the outer side of the upper part, both of said contact surfaces projecting into said cavity so as to expose said two contact surfaces to the outer side of said upper part.

2. A switch as in claim 1, wherein there is inserted into the cavity a resistor which is connected upon insertion to both contact surfaces so that it is connected in series between the external terminals and provides a self-hold function.

3. A switch as in claim 2, wherein the resistor is press-fitted into the cavity.

4. A switch as in claim 3 wherein said cavity is configured to conform to said resistor so that said cavity is substantially enclosed when said resistor is inserted into the cavity.

5. A switch as in claim 4 wherein said resistor is press fitted into said cavity.

6. A temperature-dependent switch, comprising:

a temperature-dependent switching mechanism, a housing for containing said temperature-dependent switching mechanism, said housing including a lower part and an upper part, said upper part made of insulating material and having an inner side and an outer side, two stationary contacts provided on the inner side of said upper part, each stationary contact being connected to an associated external terminal and having a contact surface on said inner side of said upper part, and a current transfer member moved by said temperature-dependent switching mechanism to electrically connect said two stationary contacts to one another in dependence of the temperature of said temperature-dependent switching mechanism, a cavity being provided in said upper part, said contact surfaces projecting into said cavity, wherein there is placed into the cavity a resistor which is connected to both contact surfaces so that it is connected in series between the external terminals and provides a self-hold function.

7. A switch as in claim 6, wherein the resistor is press-fitted into the cavity.

8. A switch as in claim 6, wherein the resistor is adhesively bonded into the cavity.

9. A switch as in claim 6, wherein the resistor is externally insulated by means of a heat-shrink sleeve surrounding the switch.

10. A temperature-dependent switch, comprising:

a temperature-dependent switching mechanism, a housing for containing said temperature-dependent switching mechanism, said housing including a lower part and an upper part, said upper part made of insulating material and having an inner side and an outer side, wherein the lower part is configured in a dish shape and the upper part in a cup shape, the upper part annularly overlapping the lower part at its rim, two stationary contacts provided on the inner side of said upper part, each stationary contact being connected to an associated external terminal and having a contact surface on said inner side of said upper part, and a current transfer member moved by said temperature-dependent switching mechanism to electrically connect said two stationary contacts to one another in dependence of the temperature of said temperature-dependent switching mechanism, a cavity being provided in said upper part, said contact surfaces projecting into said cavity.

11. A switch as in claim 10, wherein the lower part is produced from metal.

12. A switch as in claim 7, wherein the lower part has at its rim an external peripheral groove with which a ridge, configured internally on the rim of the upper part, is in engagement.

13. A temperature-dependent switch, comprising:

a temperature-dependent switching mechanism, a housing for containing said temperature-dependent switching mechanism, said housing including a lower part and an upper part, said upper part made of insulating material and having an inner side and an outer side, two stationary contacts provided on the inner side of said upper part, each stationary contact being connected to an associated external terminal and having a contact surface on said inner side of said upper part, and a current transfer member moved by said temperature-dependent switching mechanism to electrically connect said two stationary contacts to one another in dependence of the temperature of said temperature-dependent switching mechanism, a cavity being provided in said upper part, said contact surfaces projecting into said cavity, wherein two connector electrodes, each of which is connected to one of the stationary contacts, to one of the contact surfaces, and to one of the external terminals, are insert-molded into the upper part.

14. A switch as in claim 13, wherein each connector electrode is a flat metal part with which the respective external terminal is configured integrally.

15. A switch as in claim 14, wherein each terminal projects laterally out of the upper part.

16. A switch as in claim 14, wherein the respective contact surface is configured on the respective metal part.

17. A switch as in claim 14, wherein the connector electrodes lie parallel to one another in the upper part.

18. A switch as in claim 13, wherein each stationary contact is welded onto its associated connector electrode.

* * * * *

UNITED STATES PATENT AND TRADEMARK OFFICE

CERTIFICATE OF CORRECTION

PATENT NO. : 5,973,587

DATED : October 26, 1999

INVENTOR(S) : Marcel Hofsäss

It is certified that error appears in the above-identified patent and that said Letters Patent is hereby corrected as shown below:

On the Title Page, under "References Cited", "U.S. Patent Documents", Mertler Patent No. 2,753,421,
"5/1963" should be --7/1956--.

Column 9, line 29, claim 12,
"claim 7" should be --claim 11--.

Signed and Sealed this

Seventh Day of November, 2000

*Attest:*

Q. TODD DICKINSON

*Attesting Officer*

*Director of Patents and Trademarks*